United States Patent [19]

Abbott

[11] 4,191,177

[45] Mar. 4, 1980

[54] MASSAGE APPARATUS

[76] Inventor: Tony Abbott, 26726 Student St., Detroit, Mich. 48239

[21] Appl. No.: 930,186

[22] Filed: Aug. 2, 1978

[51] Int. Cl.[2] ..... A61H 7/00

[52] U.S. Cl. ..... 128/51; 128/57

[58] Field of Search ..... 128/57, 52, 33, 24.3, 128/51, 63

[56] References Cited

U.S. PATENT DOCUMENTS

| | | | |
|---|---|---|---|
| 1,274,799 | 8/1918 | Shurtleff | 128/57 |
| 2,157,395 | 5/1939 | Benson | 128/52 |
| 2,204,624 | 6/1940 | Rupp | 128/57 |
| 2,217,343 | 10/1940 | MacLevy | 128/57 |
| 2,550,841 | 5/1951 | Martinez | 128/33 |
| 2,763,261 | 9/1956 | Masmonteil et al. | 128/33 |
| 2,860,629 | 11/1958 | Bergholt | 128/57 |
| 2,934,063 | 4/1960 | Elsasser | 128/71 |
| 3,120,953 | 2/1964 | London | 272/58 |
| 3,465,750 | 9/1969 | Schawalder | 128/57 |
| 3,483,862 | 12/1969 | Takeuchi | 128/33 |
| 3,585,989 | 6/1971 | Little | 128/33 |
| 3,595,223 | 7/1971 | Castagna | 128/33 |
| 3,640,272 | 2/1972 | Hussey | 128/33 |
| 3,707,284 | 12/1972 | Waldeck | 272/58 |
| 3,736,920 | 6/1973 | Mathers et al. | 128/33 |
| 3,830,233 | 8/1974 | Hill | 128/52 |

*Primary Examiner*—Lawrence W. Trapp
*Attorney, Agent, or Firm*—Robert G. Mentag

[57] ABSTRACT

A massage apparatus for massaging the arms, legs and back of a person, separately or simultaneously. A support means, such as a table, is provided for supporting the body of a person to be massaged, and for supporting a pair of arm massage units, a pair of leg massage units, and a back massage unit. Said massage units can be manually operated or power operated. The arm and leg massage units each comprise a plurality of rollers mounted on an arcuate support means which is formed by a plurality of pivotally mounted roller support members and positioned so as provide an even distribution of massage pressure around the periphery of a person's arm or leg. The massage unit is moved longitudinally of a person's arm or leg, and in both directions. The back massage unit includes a plurality of massage rollers mounted on a V-shape spring support member for applying massage pressure to a person's back on either side of the vertebrae.

11 Claims, 12 Drawing Figures

MASSAGE APPARATUS

BACKGROUND OF THE INVENTION

1. Field of the Invention

This invention relates generally to massage apparatuses and components therefor, such as a massage apparatus that will massage all parts of a person's body with controlled pressure and with a stroking motion. parts of a person'body with controlled pressure and with a stroking motion. The invention is concerned with a massage apparatus which serves as an apparatus for massaging the arms and legs of a person, as well as the back of a person.

2. Description of the Prior Art

It is well known in the massage art to provide apparatuses for massaging the various parts of a person's body with rollers of various types. However, a disadvantage of the prior art massage apparatuses is that they are not adapted to massage completely around a joint on a person's arm or leg with controlled pressure and with a stroking motion. A further disadvantage of the prior art massage apparatuses is that the prior art massage apparatuses for use on a person's back normally include hard rollers which are adapted to go up and down a person's back and engage the spinal column which causes soreness in some instances to a person's body treated with such massage apparatus.

SUMMARY OF THE INVENTION

In accordance with the present invention, a pair of leg massage units and a pair of arm massage units are operatively mounted on a support member such as a table. A head rest is provided for the user of the apparatus, whereby he may lay down on the support member in a prone position and have his arms and legs massaged by the arm and leg massage units. A fifth massage unit is also provided for massaging the back of a person as he lays on the table. The arm and leg massage units, as well as the back massage unit can be manually operated, but said units are preferably power operated. The arm and leg massage units comprise a plurality of rollers mounted on an arcuate support means which is formed by a plurality of pivotally mounted roller support members, and positioned so as to provide an even distribution of pressure around the periphery of a person's arm or leg. The arm and leg massage units are adapted to be moved longitudinally of a person's arm or leg, in both directions. The back massage unit includes a plurality of massage rollers mounted on a V-shaped spring support member for applying such pressure to a person's back, on either side of the vertebra, and for longitudinal movement along the person's back.

Other objects, features and advantages of this invention will be apparent from the following detailed description, appended claims, and the accompanying drawings.

DESCRIPTION OF THE PREFERRED EMBODIMENTS

Figure 1:
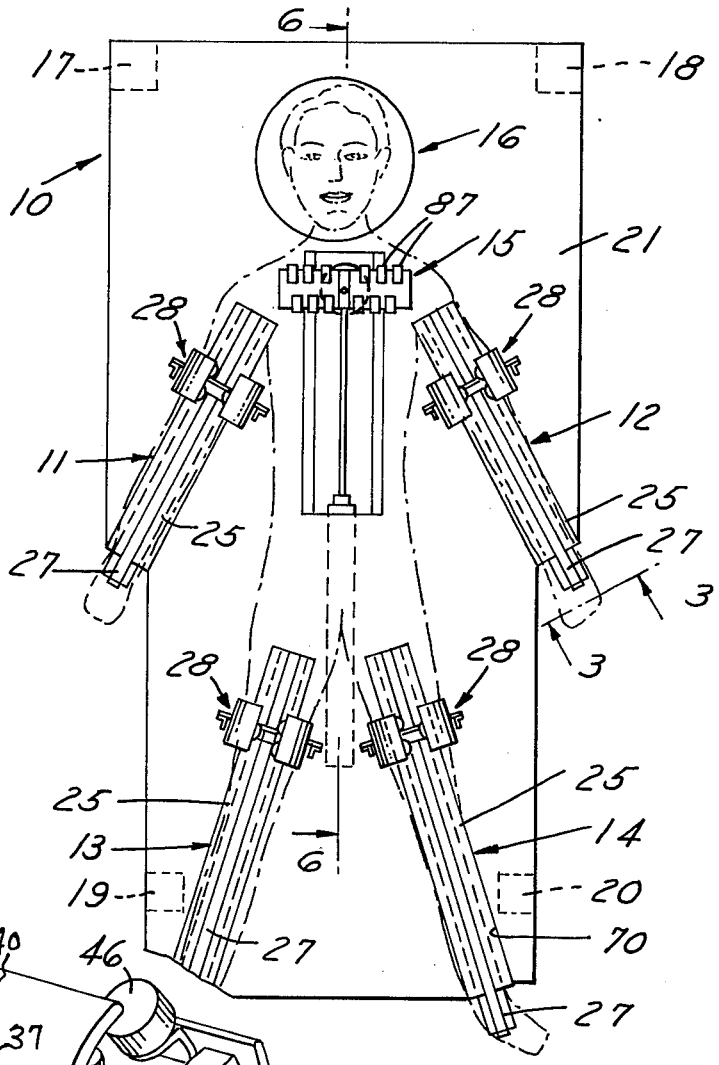
FIG. 1 is a top plan view of a massage table and associated massage apparatus made in accordance with the principles of the present invention.

Referring now to the drawings, and in particular to FIG. 1, the massage apparatus of the present invention comprises a support member or table, generally indicated by the numeral 10, on which is operatively mounted a pair of arm massage units, generally indicated by the numerals 11 and 12, and a pair of leg massage units, generally indicated by the numerals 13 and 14.

The massage apparatus of the present invention further includes a back massage apparatus, generally indicated by the numeral 15. The numeral 16 generally indicates the phantom outline position of the body of a person on which the massage units 11 through 15 would operate. The table 10 is adapted to be supported by any suitable means, as by suitable support legs 17, 18, 19 and 20 which support the table top or body rest platform 21.

The arm massage units 11 and 12 and the leg massage units 13 and 14 are each constructed in a similar manner and accordingly, the structure of only one of these units is shown in detail and that is the structure of the arm massage unit 12. The details of the structure of the arm massage unit 12 is shown in FIGS. 2, 3, 4 and 5.

Figure 2:
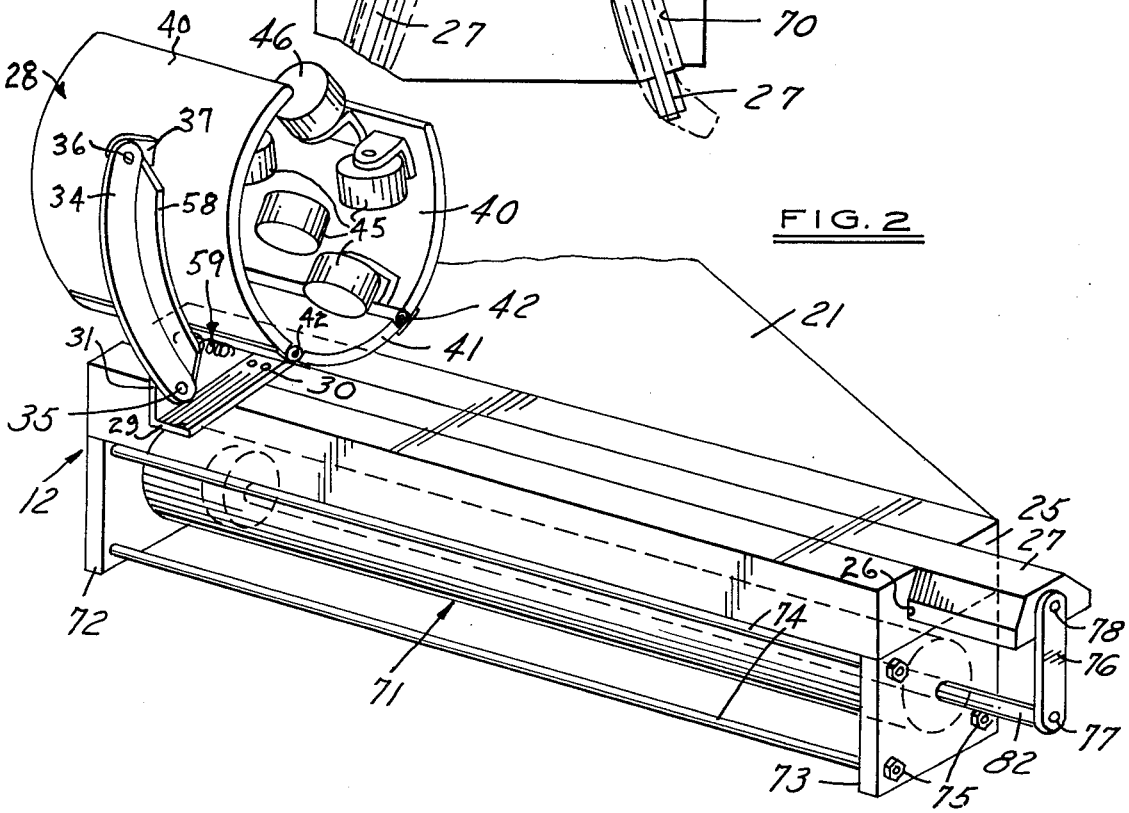
FIG. 2 is an enlarged, perspective view of one of the massage apparatuses employed with the massage table of FIG. 1 for massaging an arm or leg of a person lying on the massage table.
Figure 3:
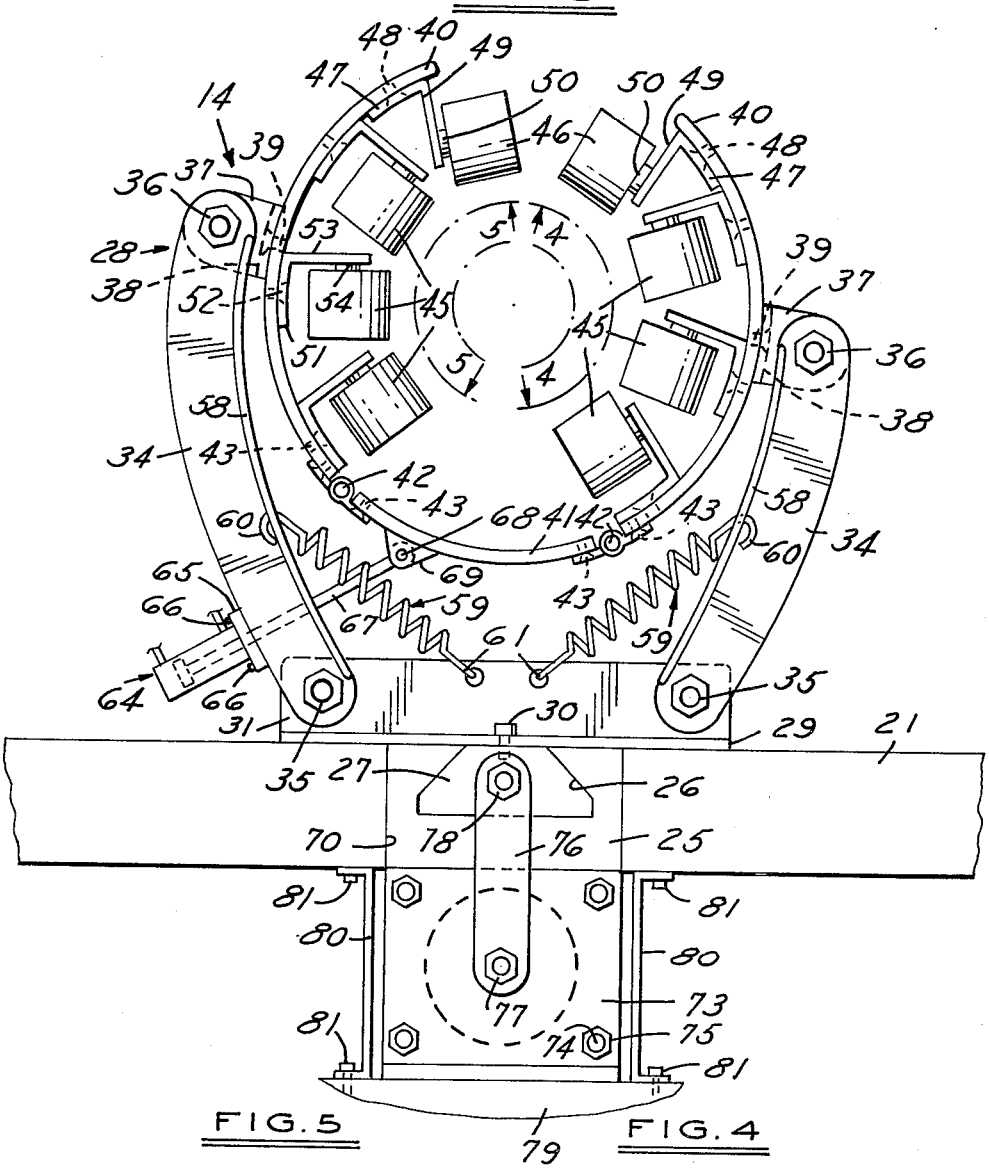
FIG. 3 is a fragmentary, enlarged elevation view of one of the massage apparatuses illustrated in FIG. 1, taken along the line 3—3 thereof, and looking in the direction of the arrows.

As shown in FIGS. 2 and 3, the arm massage unit 12 includes an elongated guide plate or guide arm 25 in which is longitudinally formed, in the upper face thereof, a T-shaped slot in which is slidably mounted an elongated carrier member or bar 27 that has a cross section shape that mates with the T-shaped slot 26. The carrier bar 27 is slidably mounted in the slot 26, and it has fixedly mounted on the inner end thereof a massage unit, generally indicated by the numeral 28. The massage unit 28 includes an attachment angle bar which includes a horizontal flange 29 that is secured by any suitable means, as by suitable screws 30 to the carrier bar 27. The vertical flange 31 of the attachment angle bar has pivotally mounted at each end thereof the lower end of an arcuate carrier angle bar which includes a transverse flange 34 that is pivotally mounted at its lower end on the angle bar 31 by any suitable means, as by a suitable pivot bolt and nut means 25. The upper end of each of the arcuate carrier angle bar flanges 31 is pivotally mounted by a suitable bolt and nut means 36 to the outer end of a lug 37 (FIG. 3). As shown in FIG. 3, the lugs 37 are each provided with an integral, right angled flange 38 which is secured by suitable machine screws 39 to the adjacent arcuate support means 40 which is shown as a flat curved plate.

As shown in FIGS. 1 and 2, the inner ends of the arcuate carrier plates 40 are connected to an intermediate curved plate 41 by suitable hinge means 42. The hinge means 42 are attached to the plates 40 and 41 by any suitable means, as by suitable machine screws 43. As shown in FIG. 3, the two arcuate plates 40 and the interconnecting arcuate plate 41 form a substantial circular roller carrier means, when they are disposed in the massage operative position of FIG. 3.

Figure 5:
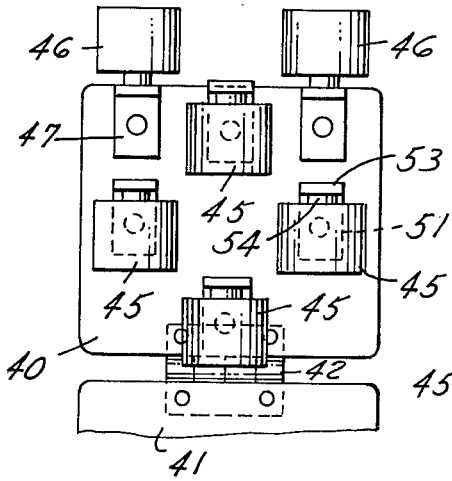
FIG. 5 is a fragmentary, elevation view of the massage apparatus illustrated in FIG. 3, taken along the line 5—5 thereof, and looking in the direction of the arrows.
Figure 4:
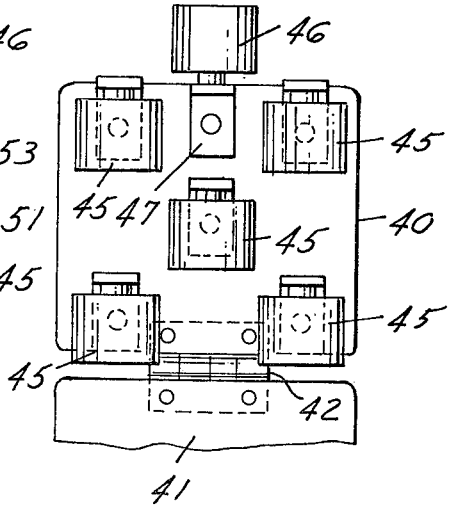
FIG. 4 is a fragmentary, elevation view of the massage apparatus illustrated in FIG. 3, taken along the line 4—4 thereof, and looking in the direction of the arrows.

As illustrated in FIGS. 4 and 5, the arcuate roller carrier plates 40 each carry a plurality of massage rollers, indicated by the numerals 45 and 46. In the illustrated embodiment of the invention, each of the carrier plates 40 have rollably mounted thereon a combination of said massage rollers. The massage rollers are mounted in alternate rows of two rollers and one roller, as shown in FIGS. 4 and 5. As shown in FIG. 3, the massage rollers 46 protrude beyond the upper ends of the arcuate plates 40, and they are mounted on a suitable shaft 50 by suitable bearing means. Each of the shafts 50 is operatively mounted on the outer faces of each carrier plate 49. Each of the carrier plates 49 are integrally attached at their inner ends to a flange 47 which is fixed by suitable machine screws 48 to the inner curved surface of the adjacent carrier plate 40 and at a point adjacent the upper end of each of the carrier plates 40. As shown in FIG. 5, one of the carrier plates 40 carries two laterally spaced apart massage rollers 46, and the other carrier plate 40 carries a single massage roller 46 in a position on the central axis of the last mentioned carrier plate 40.

Each of the massage rollers 45 is rotatably mounted on the carrier plates 40 by identical support structures. As shown in FIG. 3, each of the massage rollers 45 is rotatably supported by suitable bearing means on a shaft 54. Each of the shafts 54 is carried on the inner face of an inwardly extended carrier plate 53. The outer end of the carrier flanges 53 is integrally attached to a flange 51 which is secured to the inner surface of the adjacent carrier plate 40 by suitable machine screws 52.

As shown in FIG. 5, one of the carrier plates 40 has operatively mounted thereon four of the massage rollers 45 while the other carrier plate 40 is provided with five of the massage rollers 45, as shown in FIG. 4. The massage rollers 45 are disposed on each of the carrier plates 40 so as to be complimentary to each other. For example, on one of the carrier plates 40, two of the rollers 45 are disposed along the central axis, toward the ends of the plate 40, while on the other plate 40, a roller 45 is disposed in a central position on the central axis. Each of the carrier plates 40 carries the other rollers 45 along axes laterally spaced outwardly from the central axis, and in a similar complimentary position.

As shown in FIG. 3, each of the arcuate carrier flanges 34 has integrally formed thereon a longitudinally extended flange 58 which is disposed at right angles to the flange 34 and to which is operatively connected a coil spring, generally indicated by the numeral 59. The springs 59 function to pivot the carrier plates 40 with their aforedescribed massage rollers inwardly to an operative position as shown in FIG. 3. As shown in FIG. 3, one end 60 of each of the coil springs 59 is attached to one of the flanges 58 and the other end 61 of each of the coil springs 59 is attached to the flange 61 to which the lower ends of the arcuate carrier flanges 34 are pivotally connected.

It will be understood that the carrier plates 40 may be pivoted outwardly from their operative position shown in FIG. 3, for opening the massage rollers to allow the arm or leg of a person to be placed between the massage rollers 45 and 46. However, a power means may be employed, as shown in FIG. 3, in the form of a fluid cylinder 64 for opening the massage rollers 45 and 46. The fluid cylinder 64 may be operated either by air under pressure or hydraulic fluid under pressure. The fluid cylinder 64 would have a flange 65 that is attached by suitable machine screws 66 to the arcuate carrier flange 34. The fluid cylinder 64 has a piston rod 67 which has its outer end pivotally connected by a suitable pivot pin 68 to a lug 69 attached to the interconnecting plate 41. It will be seen that when fluid under pressure is admitted from a suitable source to the head end of the cylinder 64, that the piston rod will be moved outwardly of the fluid cylinder 64 so as to pivot the plates 40 to an open position by pivotting the arcuate carrier flanges 34 about their pivot points 35. The return springs 59 would return the massage rollers 45 and 46 to the operative massage position shown in FIG. 3 after the fluid pressure is reversed in the cylinder 64. It will be understood that the return spring means 59 could be incorporated internally in the cylinder 64, if desired.

FIGS. 2 and 3 illustrate the manner of mounting each of the massage units 11, 12, 13 and 14 on the table 10. As shown in FIG. 3, an elongated slot 70 is formed in the table top 21 for operatively receiving the elongated guide plate 25. As shown in FIG. 2, the carrier bar 27 is adapted to be actuated longitudinally of the guide plate 25 for moving the massage unit 28 back and forth along the slot 26 by a suitable fluid cylinder 71 which may be operated by air under pressure or hydraulic fluid under pressure. The cylinder 71 is supported at the ends thereof by a pair of head plates 72 and 73 which are fixedly connected together by any suitable means, as by a plurality of tie rods 74 which are secured to the head plates 72 and 73 by suitable nuts 75. The fluid cylinder 71 is provided with the usual cylinder rod 82 which has its outer end connected by a suitable machine screw 77 to the lower end of a connector bar 76. The upper end of the connecting bar 76 is connected by a suitable screw 78 to the outer end of the carrier bar 27. It will be seen that as the cylinder 71 is operated to move the cylinder rod 82 outwardly and inwardly thereof, that the carrier bar 27 will be moved forwardly and backwardly over the length of the guide plate 25 to operatively move the massage rollers 45 and 46 over the arm of a person laying prone on the table top 21.

As shown in FIG. 3, each of the guide plates 25 with its respective cylinder 71 may be attached to the table top 21 by any suitable means as by a plurality of attachment angle bars 80 which have flanges on each end thereof that are secured by suitable machine screws 81 to the underside of the table 21 and to the top of a longitudinal support member 79.

Figures 6, 7, 8, 9, 10:
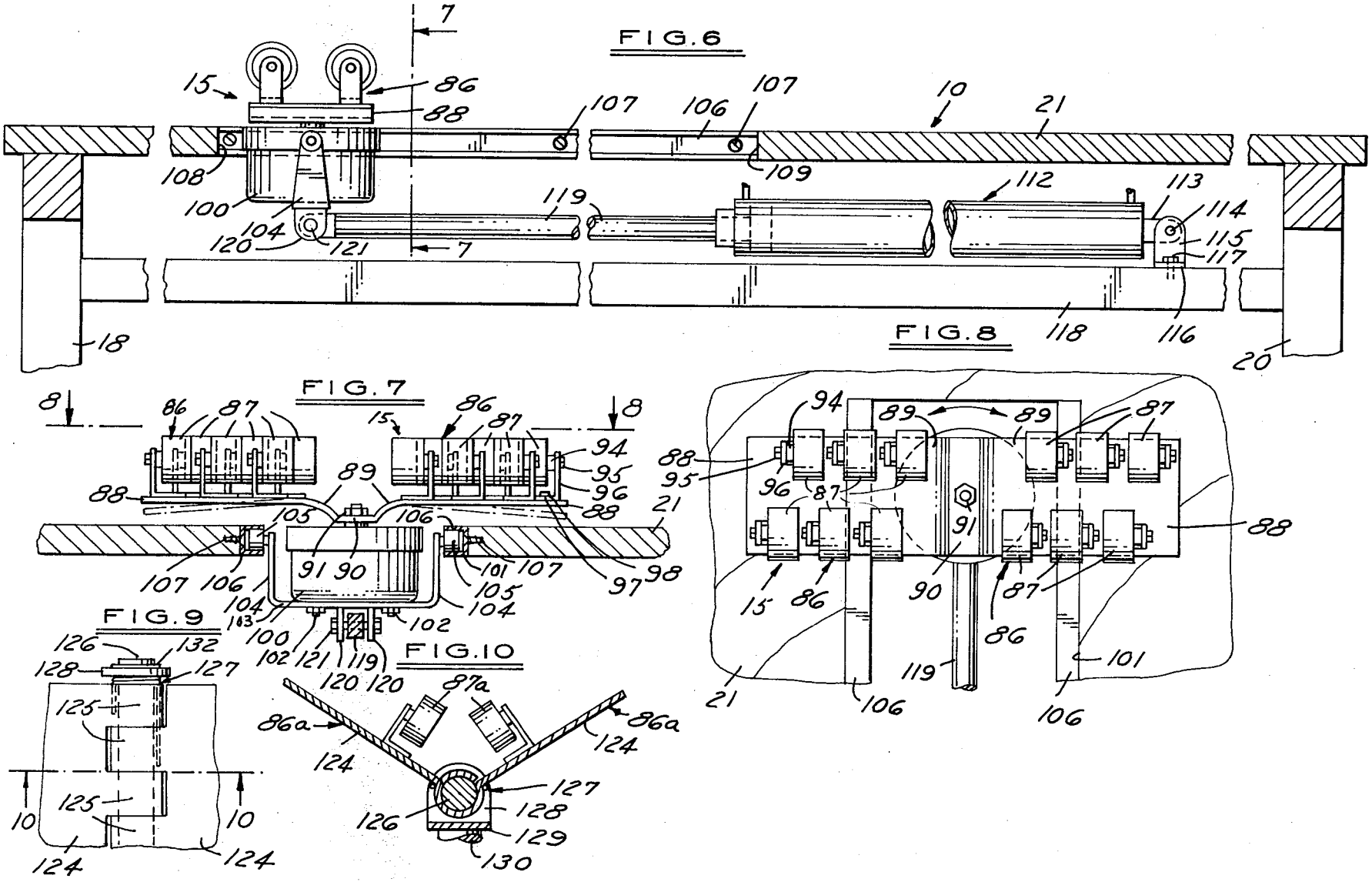
FIG. 6 is an enlarged, broken, elevation section view of the massage table structure illustrated in FIG. 1, taken along the line 6—6 thereof, and looking in the direction of the arrows.
FIG. 7 is a fragmentary, elevation section view of the massage table structure illustrated in FIG. 6, taken along the line 7—7 thereof, and looking in the direction of the arrows.
FIG. 8 is a top plan view of the massage structure illustrated in FIG. 7, taken along the line 8—8 thereof, and looking in the direction of the arrows.
FIG. 9 is a fragmentary, top plan view of a modified mounting structure for the back massage rollers illustrated in FIG. 8.
FIG. 10 is an elevation section view of the structure illustrated in FIG. 9, taken along the line 10—10 thereof, and looking in the direction of the arrows.

The back massage unit 15 is disposed on the longitudinal axis of the table 21 in an operative position for massaging the back of a person on either side of the spinal column. As shown in FIGS. 7 and 8, the back massage unit 15 comprises a pair of massage units, generally indicated by the numeral 86, which are laterally spaced apart on either side of the longitudinal axis of the table 21. Each of the back massage units 86 comprises a plurality of massage rollers 87. Each plurality of rollers 87 is shown in FIG. 8 as including a total of six rollers, with three rollers in each of two rows. The rollers 87 in one row are laterally offset from the rollers 87 in the other row in each of said group of six rollers.

As shown in FIGS. 7 and 8, each group of six rollers 87 is operatively mounted on a spring plate 88. As shown in FIG. 7, the inner end of each of the spring plates 88 is integrally connected to an arcuate attachment plate 89 which in turn is integrally connected at its inner end to a horizontal attachment plate 90. As shown in FIG. 7, each of the rollers 87 is operatively mounted on a suitable shaft 94 by suitable roller bearing means. The shaft 94 is attached to a vertical flange 96 by a suitable machine screw 95. Flange 96 has an integral right angle flange 97 which is attached by suitable screws 98 to its respective spring plate 88. All of the rollers 87 are connected to their respective spring plate 88 in the same manner.

As shown in FIG. 7, the attachment plate 90 is secured by a suitable bolt and nut means 91 to the top side of a carrier member 100. The carrier member 100 is longitudinally movable in a centrally disposed, elongated slot 101. As shown in FIG. 6, the slot 101 extends from one end 108 to the other end 109. The carrier member 100 is attached by a suitable bolt and nut means 102 to a horizontal bar 103. Integrally attached to the outer ends of the bar 103 are vertical bars 104. The upper ends of the bars 104 have operatively mounted thereon suitable guide rollers 105 which are rollably mounted in U-shaped guide channels 106 that are secured to the sides of the slot 101 by suitable machine screws 107.

As shown in FIG. 6, the carrier member 100 is adapted to be moved forwardly and backwardly in the slot 101 by a suitable fluid motor, generally indicated by the numeral 112, which may be operated by air under pressure, or hydraulic fluid under pressure. The head end of the fluid cylinder 112 is provided with attachment lug 113, which has one end fixedly secured by any suitable means to the fluid cylinder 112, and the other end pivotally connected by suitable pivot pin 114 to a vertical flange 115. The flange 115 is integrally attached to a horizontal flange 116 which is secured by suitable bolts 117 to a longitudinal support member 118 which is carried by the table legs 17, 18, 19 and 20.

The cylinder 112 is provided with the usual cylinder rod 119 which has its outer end pivotally attached by a suitable machine screw and nut means 121 to a pair of depending, spaced apart lugs 120 that are fixedly secured to the lower end of the bar 103 by any suitable means, as by welding. It will be seen that as the fluid cylinder 112 is operated, the carrier member 100 will be moved forwardly and backwardly in the slot 101 so as to move the rollers 87 forwardly and backwardly along the back of a person laying on the table top 21.

FIGS. 9 and 10 show a second embodiment of a carrier plate means for carrying the massage rollers for the back massage units 86. The parts of the embodiment of FIGS. 9 and 10 which are the same as the parts of the back massage embodiment illustrated in FIGS. 6, 7 and 8 have been illustrated by the same reference numerals followed by the small letter "a."

The back massage unit of FIGS. 9 and 10 employs a pair of roller carrier plates 124 which have a plurality of hinge attachment loops 125 formed along their inner sides as shown in FIG. 9. The hinge attachment loops 125 are spaced apart and alternately formed on the two opposed roller carrier plates 125, and they are alternately mounted on a carrier shaft 126. A coil spring, generally indicated by the numeral 127, is mounted on the carrier shaft 126, and it has its ends engaged with the lower sides of the plates 124 so as to bias them upwardly into the normal operative angled position shown in FIG. 10. The carrier shaft 126 is operatively mounted between a pair of vertical flanges 128 (FIG. 9) which are integrally attached at their lower end to a horizontal bar 129 (FIG. 10). The bar 129 is attached by any suitable means as by welding to a vertical shaft 130 (FIG. 10) which would be attached by any suitable means to the carrier member 100 shown in the embodiment for FIGS. 6, 7 and 8. The carrier shaft 126 would be held in position in the flanges 128 by a pair of suitable releasable clip rings 132 (FIG. 9). The carrier plates 124 would carry any desired number of back massage rollers **87*a* in the same manner as the embodiment of FIGS. 6, 7 and 8**.

It will be seen that as the massage units **86*a* are moved forwardly and backwardly, along the back of a person, that the rollers 87*a* will follow the contour of a person's back and will be able to pivot outwardly against the pressure of the coil spring 127** to provide optimum massaging action on the back of a person.

It will be understood that the cylinder 112 for operating the back massagers 86 and **86*a* may be constructed and arranged for any length of stroke, for example, a stroke of 18". It will also be understood that the fluid cylinders 71 for operating the arm and leg massage units 11 through 14**, may also be constructed and arranged for any desired length of stroke.

Figure 11:
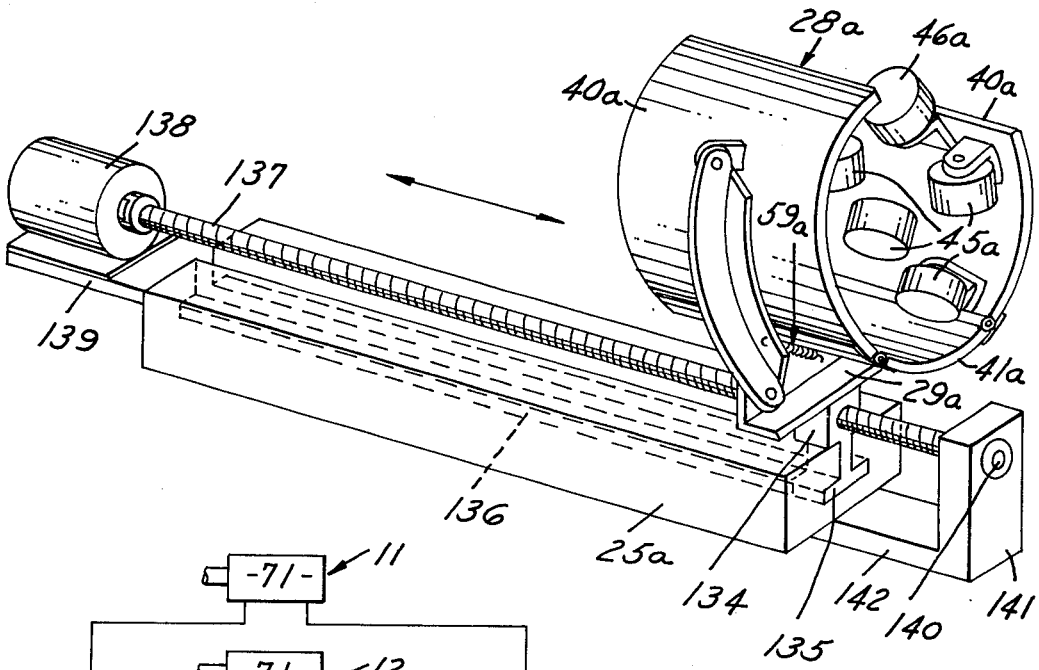
FIG. 11 is a perspective elevation view of a modified massage apparatus which may be employed with the massage table of FIG. 1.

FIG. 11 illustrates another embodiment of the invention, and the parts thereof which are the same as the parts of the first embodiment of FIGS. 1 through 4 have been marked with the same reference numerals followed by the small letter "a." FIG. 11 shows a modified embodiment in which the arm and leg massage type units **28*a*** can be moved forwardly and backwardly by an electric motor and screw means instead of a fluid motor.

The massage unit **28*a* is shown as being mounted by suitable means on a carrier block 134 which also forms a screw nut. The screw nut 134 is fixedly secured by any suitable means to the top end of a T-shaped carrier member 135 which is slidably mounted in a longitudinal T-shaped slot 136 in a guide block 25*a*. An elongated screw 137 is threadably mounted through the screw nut 134, and it has one end operatively connected to the output shaft of a suitable reversible electric drive motor 138 which is carried on the platform 139 that is fixed by any suitable means to one end of the guide plate 25*a*. The other end of the screw 137 is rotatably mounted as at 140, in a vertical support plate 141 which is carried by a horizontal plate 142 which is attached by any suitable means to the underside of the guide plate 25*a*. It will be seen that the massage unit 28*a* can be moved forwardly and backwardly along the guide plate 25***a* for massaging the arm or leg of a person.

Figure 12:
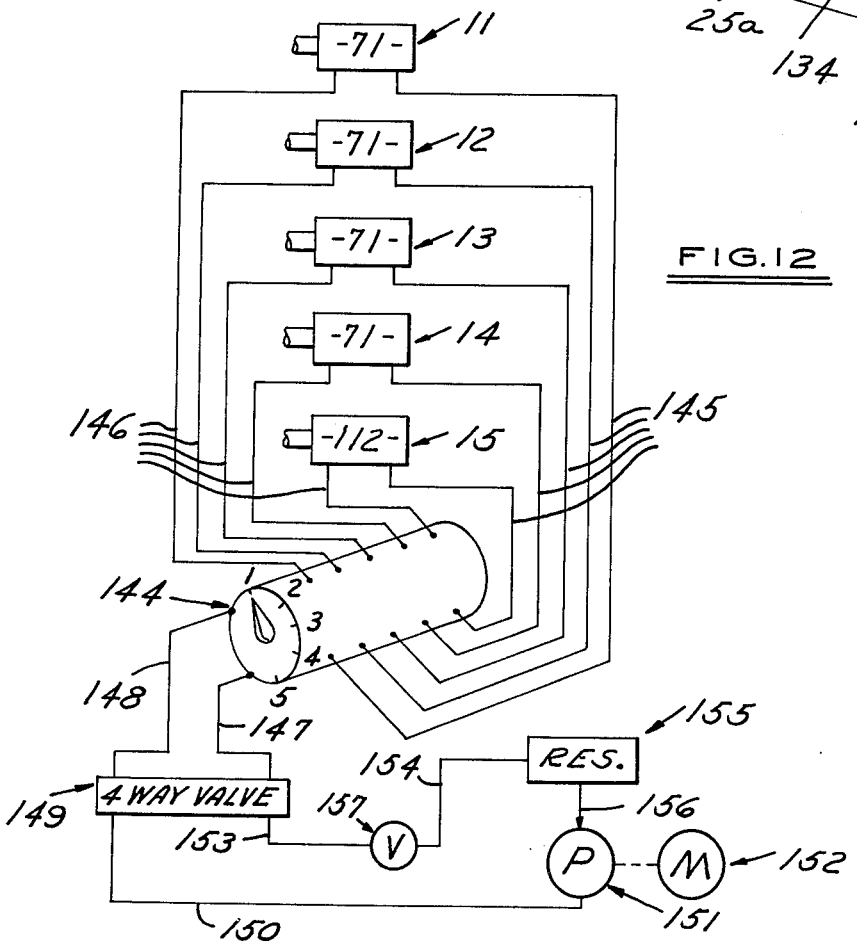
FIG. 12 is a schematic view of a fluid operated power means for the massage apparatus of the present invention.

It will be understood that the massage units 11 through 15 may be operated in any desired sequence. Accordingly, any suitable control circuit may be employed. One illustrative type of circuit for successively energizing each of the massage units 11 through 15 is illustrated in FIG. 12. The fluid cylinders 71 and 112 for the various massage units are shown as being connected by fluid supply lines 145 and 146 to a selector valve, generally indicated by the numeral 144. The selector valve 144 is connected to a suitable hydraulic fluid supply through conduits 147 and 148, a flow control four way valve, generally indicated by the numeral 149, conduits 150, 153 and 154, and a speed control valve 157. The conduit 154 is connected to a suitable hydraulic fluid reservoir 155, which in turn is connected by conduit 156 to a suitable hydraulic fluid pressure pump, generally indicated by the numeral 151. The pump 151 would be driven by a suitable electric motor 152. It will be seen that by operating the selector valve 144, as desired, that any one of the massage units 11 through 15 can be operated in a desired sequence of operations, over the arms, legs and back of a person laying on the table top 21.

The massage rollers 45, 45*a*, 46, 46*a*, 87 and 87*a* may be made from any suitable material, as for example, a styrofoam cushion may be formed around a suitable soft type rubber wheel. However, the back massage unit rollers 87 and 87*a* are preferably formed from a rubber that is harder than the soft type rubber employed for the arm and leg massage rollers 45 and 46. The softer rubber rollers are used for the rollers 45 and 46 since they must go around the joints on the arms and legs of a person and function in an optimum manner to massage the arms and legs of a person without causing soreness in the joints of the arms and legs being massaged.

While it will be apparent that the preferred embodiments of the invention herein disclosed are well calculated to achieve the results aforestated, it will be appreciated that the invention is susceptible to modification, variation and change.

What is claimed is:

1. In a massage apparatus, the combination comprising:

(a) a support member having a support surface for supporting the body of a person on which the massage apparatus is to operate;

(b) a pair of arm massage units mounted on the support member for massaging the arms of a person laying on the support surface;

(c) a pair of leg massage units mounted on the support member for massaging the legs of a person laying on the support surface;

(d) a back massage unit mounted on the support member for massaging the back of a person laying on the support surface;

(e) each of said massage units including a plurality of massage rollers;

(f) means for moving said massage units;

(g) each of said massage units including a pair of movable massage roller carrier members;

(h) a plurality of massage rollers operatively mounted on each carrier member; and, (i) means for moving said pair of massage roller carrier members on each of said massage units toward each other for normally biasing the massage rollers on the carrier members against the part of a person's body on which the respective massage unit is operating.

2. A massage apparatus as defined in claim 1, wherein:

(a) said means for moving said roller carrier members toward each other comprises a spring means.

3. A massage apparatus as defined in claim 1, wherein:

(a) said roller carrier members for the arm and leg massage units comprise a pair of pivotally mounted arcuate plates; and, (b) the plurality of massage rollers on each carrier member are mounted on the inner surface of each arcuate plate.

4. A massage apparatus as defined in claim 3, wherein:

(a) each of said arcuate plates is pivotally connected to one end of an arcuate carrier bar; and, (b) each of said arcuate carrier bars is pivotally mounted at the other end thereof to said means for moving the massage unit.

5. A massage apparatus as defined in claim 4, wherein:

(a) each of said means for moving said massage units comprises a fluid motor means.

6. A massage apparatus as defined in claim 4, wherein:

(a) each of said means for moving said massage units comprises an electric motor and drive screw means.

7. A massage apparatus as defined in claim 4, wherein:

(a) each of said massage units is carried on a guide plate movably mounted on said support member; and, (b) said means for moving said massage units is connected to said movable guide plate for moving the massage unit.

8. A massage apparatus as defined in claim 4 wherein:

(a) one end of each of the arcuate plates is hingedly connected to an interconnecting arcuate plate.

9. A massage apparatus as defined in claim 4, including:

(a) power means for moving the arcuate carrier plates to an open position against the biasing action of said spring means.

10. A massage apparatus as defined in claim 1, wherein:

(a) said means for moving said massage units includes a separate fluid power means for each of said massage units; and, (b) fluid control circuit means, including flow control apparatus, a fluid reservoir, and a fluid pressure pump is operatively connected to said fluid power means.

11. A massage apparatus as defined in claim 10, wherein:

(a) said fluid control circuit means includes a selector valve means for selective operation of each of said fluid power means.

* * * * *

UNITED STATES PATENT OFFICE

CERTIFICATE OF CORRECTION

Patent No. 4,191,177 Dated March 4, 1980

Inventor(s) Tony Abbott

It is certified that error appears in the above-identified patent and that said Letters Patent are hereby corrected as shown below:

Column 1, line 9, - delete "parts of"

Column 1, line 10, - delete "a person'body with controlled pressure and with a"

Column 1, line 11, - delete "stroking motion."

Signed and Sealed this

*Seventeenth* Day of *June 1980*

[SEAL]

*Attest:*

SIDNEY A. DIAMOND

*Attesting Officer*

*Commissioner of Patents and Trademarks*